US006695293B1

(12) United States Patent
Kamarad et al.

(10) Patent No.: US 6,695,293 B1
(45) Date of Patent: Feb. 24, 2004

(54) METAL FENCE POST WITH QUICK FENCE WIRE CONNECTION

(76) Inventors: Rodney R. Kamarad, HCR 68 Box 50, Comstock, NE (US) 68828; Darrell R. Kamarad, 7100 E. Evans Ave., Apt 217, Bld. A, Denver, CO (US) 80224

( * ) Notice: Subject to any disclaimer, the term of this patent is extended or adjusted under 35 U.S.C. 154(b) by 0 days.

(21) Appl. No.: 10/428,492

(22) Filed: May 3, 2003

Related U.S. Application Data

(63) Continuation-in-part of application No. 09/978,732, filed on Oct. 16, 2001.

(51) Int. Cl.[7] ..... E04H 17/14
(52) U.S. Cl. ..... 256/48; 256/47
(58) Field of Search ..... 256/32, 1, 47, 256/19, 65.12, 48, 49

(56) References Cited

U.S. PATENT DOCUMENTS 1,075,988 A * 10/1913 Melchert et al. ..... 256/47
1,499,933 A * 7/1924 Jones ..... 256/48
2,221,477 A * 11/1940 Gustafson ..... 256/47
2,836,397 A * 5/1958 Morrissey ..... 256/47 X
5,967,498 A * 10/1999 Junell ..... 256/19

* cited by examiner

*Primary Examiner*—John R. Cottingham
(74) *Attorney, Agent, or Firm*—Edwin H. Crabtree; Ramon L. Pizarro; Donald W. Margolis

(57) ABSTRACT

A metal fence post with a quick connection used for securing a portion of the fence wire next to the fence post. The metal fence post with a quick fence wire connection is designed to eliminate the use of a separate tying wire and twisting of the tying wire on the fence post using a pair of pliers. The metal fence post includes a plurality of equally spaced oblique studs disposed along the length of one side of the post. An equally spaced wire gap is provided between each of studs. The wire gap is dimensioned for receiving a portion of fence wire therein. Each of the oblique studs has a side profile of a trapezoidal geometric shape with a vertical base integrally attached to the side of the post and a parallel vertical top. An upper side and a lower side of the trapezoidal oblique stud is angled upwardly and inwardly from the base toward the top. In each of the studs is a vertical locking pinhole with an upper opening in the upper side and a lower opening in the lower side. The locking pinhole is used for receiving an inverted "L" shaped locking pin. The locking pinholes in the adjacent oblique studs are parallel and indexed with each other for receiving the "L" shaped locking pin therethrough and holding the wire in the wire gap.

20 Claims, 1 Drawing Sheet

METAL FENCE POST WITH QUICK FENCE WIRE CONNECTION

This application is a continuation-in-part patent application based on an earlier filed application having a title of "QUICK CONNECT FENCE POST" filed on Oct. 16, 2001 and having Ser. No. 09/978,732 by the subject inventors.

BACKGROUND OF THE INVENTION (a) Field of the Invention

This invention relates to metal fence posts used with barbed wire and other types of fence wire and more particularly, but not by way of limitation, to a metal fence post with a quick connection for securing a portion of the fence wire next to the fence post.

(b) Discussion of Prior Art

Heretofore, farmers and ranches have used different designs of metal fence posts with barbed wire for containing livestock. Also, hog wire, chicken wire, electric fence wire and other types of fence wire are used with metal fence posts. Typically two to five strands of spaced apart wire are attached to the posts. Some of the prior art fence posts include a plurality of oblique studs extending outwardly and along a length of a side of the posts. The oblique studs are used to help hold tying wire used to secure a portion of the fence wire to the side of the post.

Currently, the use of a separate tying wire is a method of choice in securing fence wire to the side of a metal fence post. The tying wire is wrapped around a portion of the metal fence post and a portion of the fence wire and snugly tied using a pair of pliers. The problem with using tying wire is it takes time and is tedious to manipulate. Also, the tying wire can come loose and the tying wire and the fence wire can slide vertically along the length of the metal fence post. When the fence wire is allowed to slide, the strands of wire attached to the fence post are no longer parallel to each other and uneven distances between the wire strands occur. The uneven distances between the strands expose a space, which attracts livestock to crawl through. Also because barbed wire is difficult to stretch, barbs are snagged against the fence post, when the tying wire is twisted around the wire and against the side of the metal fence post.

In U.S. Pat. No. 3,266,778 to Wogerbauer, an espalier metal stake is disclosed for threading wire through lopes in flanges of the stake. The stake and the wire is used for holding fruit and vegetable vine plants. In U.S. Pat. No. 2,221,477 to Gustafson and U.S. Pat. No. 2,836,397 to Morrissey, two different types of chain link fence attachments are described. The attachments are used for holding the chain link fence next to a side of a metal fence post.

The above mentioned prior art patents and the method of securing a portion of a strand of fence wire to a metal fence post using a separate tying wire do not disclose or provide the unique features, structure, function and advantages of the subject metal fence post having a quick fence wire connection as described herein.

SUMMARY OF THE INVENTION

In view of the foregoing, it is a primary objective of the subject invention to provide a metal fence post with a quick fence wire connection that eliminates the use of a separate tying wire and eliminate twisting of the tying wire on the fence post using a pair of pliers, which is time consuming and tedious.

Another object of the invention is a portion of barbed wire or other types of wire fence can be quickly held in a wire gap between a pair of oblique studs disposed along the length of a side of the metal fence posts.

Yet another object of the invention is through the use of the pair of oblique studs with a stud pin, a strand of wire will no longer slip vertically along a length of the metal fence post. The slippage of the wire on the post causes an uneven distance between strands of wire allowing a space for livestock to crawl through.

Still another object of the invention is the metal fence post with the oblique studs and stud pin can be used with a variety of different types of fence wire. Also barbed wire with barbs thereon do not interfere with the attachment of the wire to the side of the metal fence post.

The subject invention includes a metal fence post with a plurality of pairs of oblique studs spaced along one side of the post. A wire gap is provided between each pair of the studs. The studs are equally spaced from each other and along the length of the metal fence post. The wire gap is dimensioned for receiving a portion of fence wire therein. Each of the oblique studs has a side profile of a trapezoidal geometric shape with a vertical base integrally attached to the side of the post and a parallel vertical top. An upper side and a lower side of the trapezoidal oblique stud is angled upwardly and inwardly from the base toward the top. In each of the studs is a vertical locking pinhole with an upper opening in the upper side and a lower opening in the lower side. The locking pinhole is used for receiving an inverted "L" shaped locking pin. The locking pinholes in the adjacent oblique studs are parallel and indexed with each other for receiving the "L" shaped locking pin therethrough and holding the wire in the wire gap.

These and other objects of the present invention will become apparent to those familiar with the metal fence posts and fence wire connections when reviewing the following detailed description, showing novel construction and combination of elements and function as described, and more particularly defined by the claims, it being understood that changes in the embodiments of the disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DESCRIPTION OF THE PREFERRED EMBODIMENTS

Figure 1:
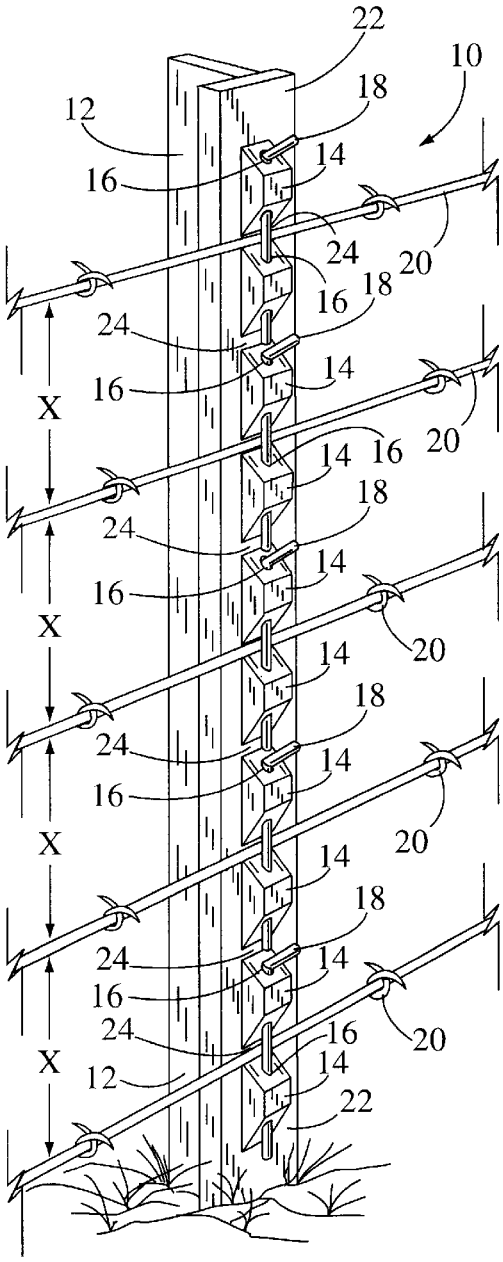
FIG. 1 is a perspective view of the subject metal fence post with quick fence wire connection. In this drawing, the metal fence post is shown with a plurality of oblique studs with pinholes used for receiving inverted "L" shaped locking pins therethrough. The pins and selected pairs of oblique studs are used for holding parallel strands of barbed wire in a wire gap between the oblique studs and next to a side of the fence post.

In FIG. 1, a perspective view of the subject metal fence post with quick fence wire connection is illustrated and having general reference numeral 10. The metal fence post with wire connection 10 is shown with a metal post 12 having a "T" shaped cross section. While the "T" shaped cross section is shown, it can be appreciated that the post 12 can have any number of different types of cross sections and post designs without departing from the spirit and scope of the invention as described. The metal post 12 in this drawing includes a plurality of oblique studs 14 equally spaced along a length of the post. Each of the oblique studs 14 includes vertical pinholes 16. The pinholes 16 are parallel and indexed with each other in adjacent studs 14. The pinholes 16 are used for receiving inverted "L" shaped locking pins 18 therethrough.

In this drawing, the locking pins 18 and adjacent oblique studs 14 are used for holding a portion of five parallel strands of barbed wire 20 next to a side 22 of the fence post 12. While the metal fence post with wire connection 10 is shown for receiving and holding a portion of five parallel strands of barbed wire 20, it should be kept in mind that the fence post 12 can be used for holding any number of strands of parallel barbed wire 20. Also, the invention could include any number of oblique studs disposed along the length of the side 22 of the fence post 12 for holding the strands of wire. While the barbed wire 20 is shown in the drawings, it should be kept in mind that any type of fence wire can be used equally well with the subject metal fence post with quick fence connection 10.

Typically, the metal fence post 12 will hold three to six parallel strands of wire 20, with the strands spaced apart a distance "X". The distance "X" is in a range of 6 to 18 inches and more specifically 12 to 14 inches with the space between the wire strands small enough to prevent livestock from crawling through. The distance "X" will vary depending on the number of wire strands attached to the fence post 12.

Also, it should be mentioned that because the studs 14 are equally spaced next to each other, added stands of wire 20 can be placed between the adjacent pair of oblique studs 14. The additional strand or strands of wire 20 is held next to the side of the post 12 by extending the length of locking pin 18 and having it received through the pinholes 16 of both adjacent pairs of oblique studs 14. Obviously, by placing added strands of wire 20 between the adjacent oblique studs 14, the post 12 can have from 6 to 10 or more strands of wire 20 with a spacing of approximately 4 to 8 inches between each strand.

Figure 2:
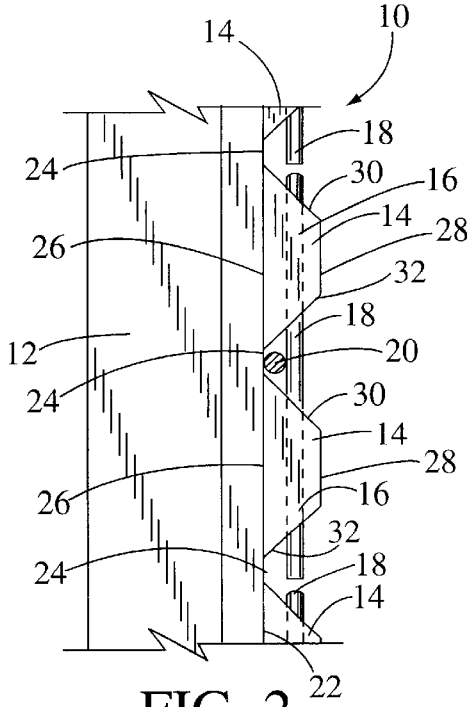
FIG. 2 is a side view of a portion of the metal fence post with a pair of oblique studs. A wire gap, between two of the studs is shown with a portion of the barbed wire received therein. The barbed wire is shown in cross section and held in the wire gap by the inverted "L" shaped locking pin received through locking pinholes in the studs and above the wire in the wire gap.

In FIG. 2, a side view of a portion of the metal fence post 12 with a pair of oblique studs 14 is shown. A wire gap 24, between the upper stud 14 and lower stud 14, is shown with a portion of the barbed wire 20 received therein. The wire gap 24 is the same dimension along the length of the post 12 and between each oblique stud 14. The barbed wire 20 is shown in cross section and held in the wire gap 24 by the inverted "L" shaped locking pin 18. The locking pin 18 is received through the locking pinholes 16 in the adjacent oblique studs 14 with a portion of the locking pin 18 bridged over the wire 20 for holding it in the wire gap 24. Obviously, the wire gap 24 is disposed below the pinholes 16 so that the locking pin 18 can be easily received over the top of the wire 20 resting in the wire gap 24 as shown. The pinholes 16 are shown in dashed lines in this drawing and in FIG. 3.

It should be mentioned, that each of the oblique studs 14 have a side profile of a trapezoidal geometric shape. The studs 14 include a vertical base 26 integrally attached to the side 22 of the post 12 and a parallel vertical top 28. The vertical top 28 has a length shorter than a length of the parallel vertical base 26. An upper side 30 and a lower side 32 of the trapezoidal oblique stud 14 are angled or flared upwardly and inwardly from the base 26 toward the top 28. The flared lower side 32 of an upper stud 14 and the flared upper side 30 of an adjacent lower stud 14 act as a guide for inserting a portion of the wire 20 into the wire gap 24 before the locking pin 18 is inserted through the adjacent pinholes 16.

In each of the studs 14, the vertical locking pinhole 16 includes an upper opening in the upper side 30 and a lower opening in the lower side 32. As mentioned above, the adjacent pinholes 16 are used for receiving the inverted "L" shaped locking pin 18. The locking pin 18 can be made of various dimensions of wire depending on the diameter of the locking pinhole 16. Typically, a 9-gauge wire is used for making the inverted "L" shaped locking pin 18.

Figure 3:
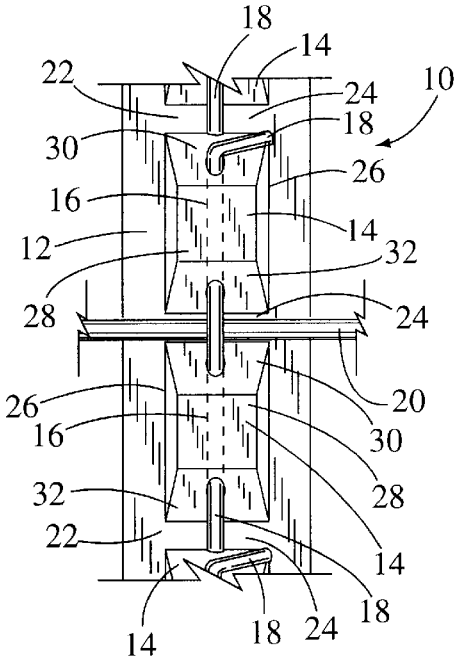
FIG. 3 is a front view of the metal fence post with the oblique studs and the inverted "L" shaped locking pin shown in FIG. 2. In this view, the wire is shown received in the wire gap with a portion of the "L" shaped locking pin disposed above the wire and preventing it from being removed from the wire gap.

In FIG. 3, a front view of the metal fence post 12 with the pair of oblique studs 14 is shown with the inverted "L" shaped locking pin 18 received through the pinholes 16 in the upper and lower studs as shown in FIG. 2. In this view, the wire 20 is shown received in the wire gap 24 with a portion of the "L" shaped locking pin 18 disposed above the wire 20 and preventing it from being removed from the wire gap 24.

In operation, when a portion of the wire 20 is inserted into the wire gap 24 and the inverted "L" shaped locking pin 18 is inserted through the pinholes 16 in the adjacent oblique studs 14, the locking pin 18 is received over the top of the portion of the wire 20. Thus, the wire 20 is held firmly in the wire gap 24 and against a portion of the "L" shaped locking pin 18. Obviously, by removing the locking pin 18 from the pinholes 16, the wire 20 can be easily removed from the metal fence post 12.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A metal fence post with quick fence wire connection adapted for receiving a portion of a first strand of fence wire and holding the fence wire thereon, the fence wire connection comprising:

a metal fence post with a first pair of oblique studs in one side of said post and formed as one piece:

first vertical pinholes in said first pair of oblique studs;

a first wire gap disposed between said first pair of oblique studs, said first wire gap adapted for receiving a portion of the fence wire therein; and a first locking pin received in said first vertical pinholes and above said first wire gap, said first locking pin adapted for holding the portion of the first strand of fence wire in said wire gap.

2. The fence wire connection as described in claim 1 wherein said first locking pin is an inverted "L" shaped first locking pin.

3. The fence wire connection as described in claim 1 wherein said first vertical pinholes are parallel and indexed with each other in said first pair of oblique studs.

4. The fence wire connection as described in claim 1 wherein said first pair of oblique studs have a side profile of a trapezoidal geometric shape, said first pair of oblique studs including a vertical base integrally attached to the side of said post and parallel to a vertical top, the vertical top having a length shorter than a length of the vertical base, said studs also including an upper side and a lower side angled upwardly and inwardly from the vertical base to the vertical top.

5. The fence wire connection as described in claim 1 further including a second pair of oblique studs in one side of said post and disposed below said first pair of oblique studs, said second pair of oblique studs having second vertical pinholes therein for receiving a second locking pin therethrough and a second wire gap between said second pair of oblique studs, said second wire gap adapted for receiving a portion of a second strand of fence wire therein.

6. The fence wire connection as described in claim 5 wherein said first wire gap and said second wire gap have an equal space between said first pair of oblique studs and between second pair of oblique studs.

7. The fence wire connection as described in claim 6 further including a third wire gap disposed between said first pair of oblique studs and said second pair of oblique studs, said third wire gap having an equal space with said first and second wire gaps, said third wire gap adapted for receiving a portion of a third strand of fence wire therein.

8. The fence wire connection as described in claim 5 wherein said second pair of oblique studs have a side profile of a trapezoidal geometric shape, said second pair of oblique studs including a vertical base integrally attached to the side of said post and parallel to a vertical top, the vertical top having a length shorter than a length of the vertical base, said studs also including an upper side and a lower side angled upwardly and inwardly from the vertical base to the vertical top.

9. A metal fence post with quick fence wire connection adapted for receiving a portion of first and second strands of fence wire and holding the fence wire thereon, the fence wire connection comprising:

a metal fence post with a first pair of oblique studs formed as one piece on one side of said post:

first vertical pinholes in said first pair of oblique studs;

a first wire gap disposed between said first pair of oblique studs, said first wire gap adapted for receiving a portion of the fence wire therein;

a first locking pin received in said first vertical pinholes and above said first wire gap, said first locking pin adapted for holding the portion of the first strand of fence wire in said wire gap a second pair of oblique studs in one side of said post and disposed below said first pair of oblique studs;

second vertical pinholes in said second pair of oblique studs;

a second wire gap between said second pair of oblique studs, said second wire gap adapted for receiving a portion of a second strand of fence wire therein; and a second locking pin received in said second vertical pinholes and above said second wire gap, said second locking pin adapted for holding a portion of the second strand of wire fence therein.

10. The fence wire connection as described in claim 9 wherein said first and second locking pins are inverted "L" shaped first and second locking pins.

11. The fence wire connection as described in claim 9 wherein said first and second vertical pinholes are parallel and indexed with each other in said first and second pair of oblique studs.

12. The fence wire connection as described in claim 9 wherein said first wire gap and said second wire gap have an equal space between said first pair of oblique studs and between second pair of oblique studs.

13. The fence wire connection as described in claim 12 further including a third wire gap disposed between said first pair of oblique studs and said second pair of oblique studs, said third wire gap having an equal space with said first and second wire gaps, said third wire gap adapted for receiving a portion of a third strand of fence wire therein.

14. The fence wire connection as described in claim 9 wherein said first and second pairs of oblique studs have a side profile of a trapezoidal geometric shape, said first and second pair of oblique studs including a vertical base integrally attached to the side of said post and parallel to a vertical top, the vertical top having a length shorter than a length of the vertical base, said studs also including an upper side and a lower side angled upwardly and inwardly from the vertical base to the vertical top.

15. A metal fence post with quick fence wire connection adapted for receiving a portion of a first strand of fence wire and holding the fence wire thereon, the fence wire connection comprising:

a metal fence post with a first pair of oblique studs integrally formed in one side of said post, said studs having a trapezoidal geometric shape, said first pair of oblique studs including a vertical base integrally attached to the one side of said post and parallel to a vertical top, the vertical top having a length shorter than a length of the vertical base, said studs also including an upper side and a lower side angled upwardly and inwardly from the vertical base to the vertical top;

first vertical pinholes in said first pair of oblique studs, said pinholes parallel and indexed with each other;

a first wire gap disposed between said first pair of oblique studs and adjacent the vertical base of said studs, said first wire gap adapted for receiving a portion of the first strand of fence wire therein; and an inverted "L" shaped first locking pin received in said first vertical pinholes and above said first wire gap, said first locking pin adapted for holding the portion of the first strand of fence wire in said wire gap.

16. The fence wire connection as described in claim 15 further including a second pair of oblique studs integrally formed in one side of said post and disposed below said first pair of oblique studs, said second pair of oblique studs having second vertical pinholes therein for receiving a second inverted "L" shaped locking pin therethrough, said second pair of oblique studs having a trapezoidal geometric shape, said second pair of oblique studs including a vertical base integrally attached to the one side of said post and parallel to a vertical top, the vertical top having a length shorter than a length of the vertical base, said second pair of studs also including an upper side and a lower side angled upwardly and inwardly from the vertical base to the vertical top and a second wire gap disposed between said second pair of oblique studs and adjacent the vertical base of said studs, said second wire gap adapted for receiving a portion of a second strand of fence wire therein.

17. The fence wire connection as described in claim 16 wherein said first wire gap and said second wire gap have an equal space between said first pair of oblique studs and between second pair of oblique studs.

18. The fence wire connection as described in claim 17 further including a third wire gap disposed between said first pair of oblique studs and said second pair of oblique studs, said third wire gap having an equal space with said first and second wire gaps, said third wire gap adapted for receiving a portion of a third strand of fence wire therein.

19. The fence wire connection as described in claim 16 wherein said second vertical pinholes are parallel and indexed with each other in said second pair of oblique studs.

20. The fence wire connection as described in claim 16 further including a third pair of oblique studs integrally formed in one side of said post and disposed below said second pair of oblique studs, said third pair of oblique studs having third vertical pinholes therein for receiving a third inverted "L" shaped locking pin therethrough, said third pair of oblique studs having a trapezoidal geometric shape, said third pair of oblique studs including a vertical base integrally attached to the one side of said post and parallel to a vertical top, the vertical top having a length shorter than a length of the vertical base, said third pair of studs also including an upper side and a lower side angled upwardly and inwardly from the vertical base to the vertical top and a third wire gap disposed between said third pair of oblique studs and adjacent the vertical base of said studs, said third wire gap adapted for receiving a portion of a third strand of fence wire therein.

* * * * *